United States Patent [19]

Eshelman et al.

[11] 4,096,724

[45] Jun. 27, 1978

[54] METHOD OF COILING A FLAT STRIP

[75] Inventors: Larry J. Eshelman, Pendleton; James R. Bish, Anderson, both of Ind.

[73] Assignee: General Motors Corporation, Detroit, Mich.

[21] Appl. No.: 801,069

[22] Filed: May 27, 1977

[51] Int. Cl.[2] ..... B21C 47/08; B21D 5/14

[52] U.S. Cl. ..... 72/132; 72/146; 72/172

[58] Field of Search ..... 72/129, 130, 131, 132, 72/146, 148, 169, 170, 172, 173; 242/78.1

[56] References Cited

U.S. PATENT DOCUMENTS

| | | | |
|---|---|---|---|
| 3,303,679 | 2/1967 | Cavagnero | 72/35 |
| 3,336,777 | 8/1967 | Bodnar | 72/146 |
| 3,357,222 | 12/1967 | Konstandt | 72/146 |
| 3,910.089 | 10/1975 | Meier et al. | 72/146 |

FOREIGN PATENT DOCUMENTS

| | | | |
|---|---|---|---|
| 590,410 | 1/1934 | Germany | 72/148 |
| 1,441,301 | 6/1976 | United Kingdom | 242/78.1 |

*Primary Examiner*—E. M. Combs
*Attorney, Agent, or Firm*—John P. Moran

[57] ABSTRACT

A method of coiling a flat strip, including the steps of advancing and supporting the strip, forming a partial loop on the leading end thereof while continuing to advance the strip toward an upcoiling nest where the coiling is completed, shearing the advancing strip when the coil attains a predetermined size, completing the coiling of the sheared end thereof, and ejecting the finished coil.

6 Claims, 1 Drawing Figure

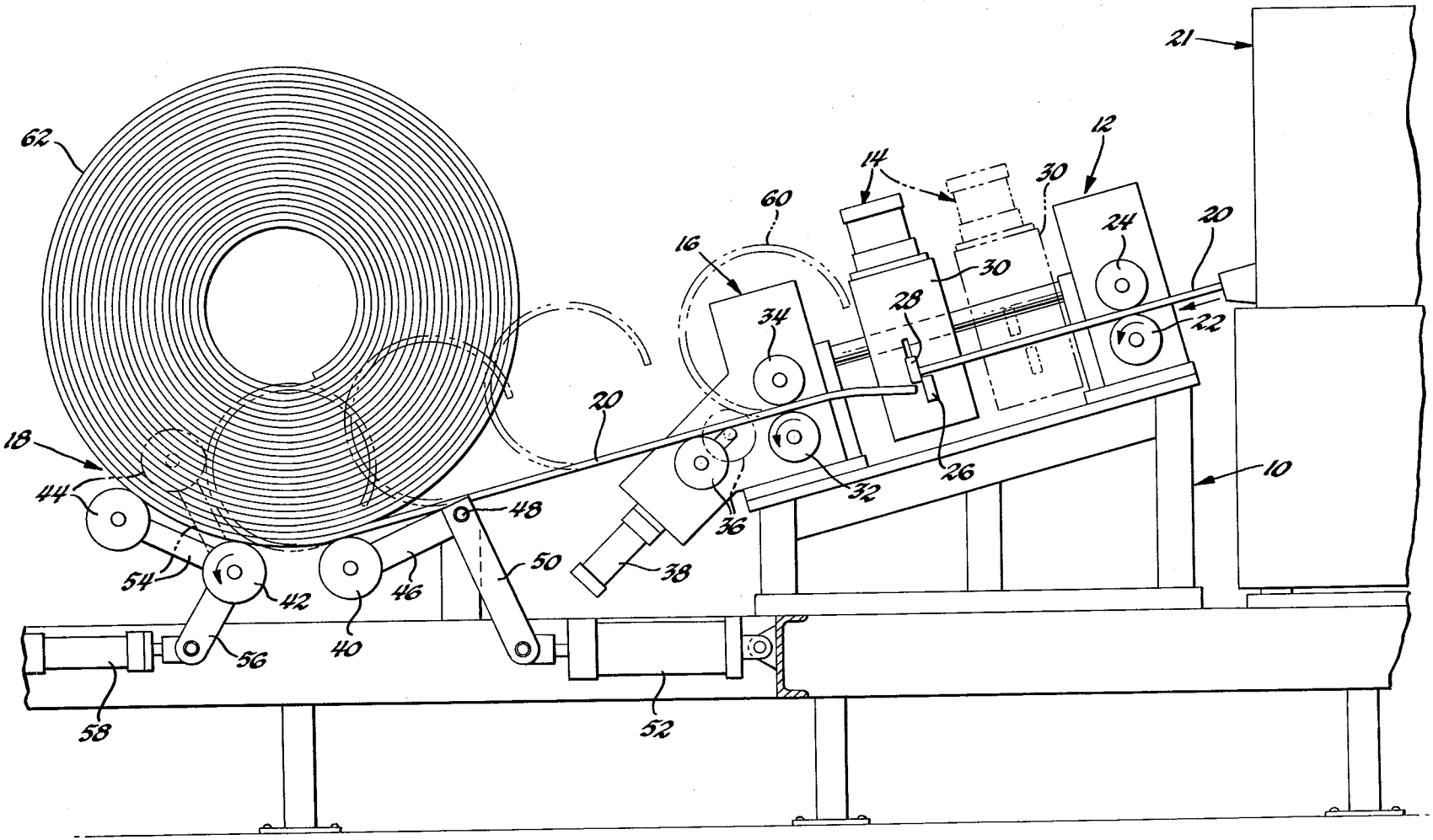
10
12
14
16
18
20
21
22
24
26
28
30
32
34
36
38
40
42
44
46
48
50
52
54
56
58
60
62

METHOD OF COILING A FLAT STRIP

This invention relates generally to a method for coiling a flat strip and, more particularly, to an improved coiling method embodying an "upcoiling" technique.

Heretofore, upcoiling equipment and processes have generally been complicated and expensive, including, for example, wrap-around belt means for initiating the coiling action, and a driven expanding arbor arrangement for completing the coiling operation and swinging the finished coil in an arc prior to collapsing the arbor for ejecting the coil.

Accordingly, a general object of the invention is to provide an improved coiling method which is relatively simple and inexpensive.

Another object of the invention is to provide an improved method of coiling a flat strip, including means for pinch rolling the strip, cylinder-actuated roller means for initiating the coiling action, and an upcoiling nest including cooperating driven and cylinder-actuated rollers for completing the coiling operation and ejecting the finished coil.

A further object of the invention is to provide a method of coiling a flat strip, including the steps of advancing the strip through pinch driving roller means, deflecting the advancing end of the strip upwardly at the exit of the pinch roller means to form a partial loop suitable for clearing a partially enclosed portion of the pinch roller means, continuing the advancement of the partial loop and strip to a coil drive roller and a guide roller positioned so as to simultaneously engage the partial loop and effectuate the winding of the partial loop and strip into a finished coil, the guide roller moving to accommodate the progressively increasing size of the coil, shearing the strip, continuing the coiling of the severed strip by continued movement by the coil drive roller, and ejecting the finished coil.

These and other objects and advantages of the invention will be apparent when reference is made to the following description and accompanying drawing, wherein:

The FIGURE is a side elevational view of an apparatus on which the steps of the inventive process is performed.

Referring now to the drawing in greater detail, there is illustrated generally a framework 10 constructed to support on a predetermined angle, such as 15° with horizontal, a powered pinch roll assembly 12, a powered moving shear assembly 14, a primary loop former assembly 16, and an upcoiler assembly 18 through which a strip 20 of a low melting point alloy is sequentially processed. The various assemblies 12, 14, 16 and 18 are adapted to accommodate a strip 20 of predetermined width, thickness and weight, a typical strip 20 being 3 inches wide, ¾ inch thick and weighing 12 pounds per foot. The strip 20 is supplied to the pinch roll assembly 12 by a suitable continuous caster mechanism 21.

More specifically, the powered pinch roll assembly 12 includes an axially fixed and rotatably powered lower roller 22 and a vertically movable upper roller 24 adapted to pinch and drive the strip 20 therebetween.

The shear assembly 14 includes a rigid, upwardly directed lower shear knife 26 and a vertically powered, downwardly directed upper shear knife 28, both mounted on a mechanism 30 adapted to being powered to advance and retract in a movement parallel to the flow path of the strip 20.

The primary loop former assembly 16 includes an axially fixed and rotatably powered lower roller 32, a vertically movable upper roller 34, and a loop form roller 36 movable by a suitable cylinder 38 at a predetermined angle at the exit end of the rollers 32 and 34 adapted to deflect the strip 20 upwardly into a partial loop.

The upcoiler assembly 18 includes a nest formed by an ejection roller 40, a coil drive roller 42 and a guide or back-up roller 44. The ejection roller 40 is rotatably mounted on the end of a first arm 46 pivotally mounted on a pivot pin 48. A second arm 50 is secured at one end thereof to the pivot pin end of the first arm 46 at approximately a 90° angle therewith and movable at the other end thereof by a suitable cylinder 52. The back-up roller 44 is rotatably mounted on one end of a third arm 54. The coil drive roller 42 is rotatably powered on the other end of the third arm 54. The coil drive roller 42 is rotatably powered on the other end of the third arm. A fourth arm 56 is secured at one end thereof to the drive roller end of the third arm 54 at approximately a 90° angle therewith and operably connected at the other end thereof to a suitable cylinder 58.

In operation, the strip 20 is first inserted between the rollers 22 and 24. The upper roller 24 is lowered to pinch the strip therebetween. The lower powered roller 22 is rotated to drive the strip 20 between the spaced-apart shear knives 26 and 28, supported on the lower knife 26, and thence to the bite point between the rollers 32 and 34, whereupon the upper roller 34 is lowered to pinch the strip 20 therebetween, and the lower powered roller 32 is rotated, supplementing the driving action of the powered roller 22 to drive the strip 20 toward the loop form roller 36. The latter is moved by the cylinder 38 to deflect the end portion of the strip 20 upwardly, beyond its elastic limit, at the exit from the rollers 32 and 34 until the substantially circumferential movement thereof assumes a primary loop 60 of approximately three-fourths of one full loop. The diameter of the primary loop 60 is determined by the distance between the upper roller 34 and the loop form roller 36.

As the strip 20 continues to advance, the open one-fourth portion of the primary loop clears the roller 34. The roller 36 is retracted until it is aligned with the flow path of the oncoming strip, serving to support the latter as it advances to the nest formed by an ejection roller 40, a drive roller 42 and a guide or back-up roller 44.

The rollers 42 and 44 are positioned so as to substantially simultaneously engage the advancing primary loop 60. The resultant forces caused by the combination of the forward force of strip 20 movement, the opposing force of the back-up roller 44, the vertical force of the alloy strip weight, the flexural characteristic of the alloy involved, and the 15° angle of incidence cause the primary loop 60 to first form to a full 360° and then to spiral form a continuous coil 62. As the size and weight of the coil 62 increases, the back-up roller 44 progressively lowers, being operatively connected to the cylinder 58. If desired, suitable upright supports (not shown) may be constructed on oppositely disposed sides of the coil 62 to keep it from tipping or telescoping.

Once the coil 62 has attained a predetermined finished coil size, the upper shear knife 28 is powered downwardly to begin cutting the strip 20. As the shear knife 28 cuts through the thickness of the strip 20, the mechanism 30 advances with the strip 20 until the cutting operation is completed, after which the mechanism 30 is returned to its original position. The drive roller 42 is then actuated to drive the trailing end of the strip 20 into the finished coil 62. Once the coil 62 is complete, the cylinder 52 is actuated to raise the ejection roller 40, pivoting about the pivot pin 48, to urge the coil 62 over the back-up roller 44, ejecting it onto a conveyor (not shown).

It should be apparent that strips of materials other than low melting point alloys may be coiled by the inventive process, so long as such strip can be bent beyond its elastic limit by the loop form roller 36 partially around the upper pinch roller 34.

While but one embodiment of the invention has been shown and described other modifications thereof are possible.

What is claimed is:

1. A method of coiling a flat strip, said method comprising the following steps:

a. advancing the strip longitudinally at substantially constant speed through first and second longitudinally spaced sets of pinch driving rollers having parallel axes;

b. deflecting the end portion of the strip upwardly at the exit from said second set of pinch driving rollers, and continuing to advance said strip to form by bending beyond the elastic limit with substantially circumferential movement of the end of the strip a partial loop capable of clearing an upper one of the second set of pinch driving rollers;

c. discontinuing the deflection of said strip while continuing the longitudinal advancement thereof to advance said partial loop and strip to a coil drive roller and a guide roller having axes substantially parallel to said first axes and initially located to engage an outboard circumferential surface of the partial coil substantially simultaneously to impart circumferential motion thereto in a windup direction and thereafter to move so as to maintain engagement with the periphery of the coil formed by continued winding action;

d. continuing the coiling of the trailing end of the strip by continued advancement thereof by the coil drive roller; and e. ejecting the finished coil.

2. A method of coiling a flat metal strip, said method comprising the following steps:

a. advancing the strip longitudinally between two pinch driving rollers;

b. feeding the strip between two spaced apart shear blades;

c. feeding the strip between two additional pinch driving rollers;

d. deflecting the end of the strip at the exit of the two additional driving rollers into a partial loop providing a predetermined gap between the end thereof and the advancing flat strip, the gap being such that the partially looped end of the strip clears the partially enclosed driving roller as the strip continues to advance longitudinally;

e. coiling the longitudinally advancing partial loop and strip into a coil of a predetermined diameter;

f. shearing the strip by actuating the shear blades; and g. ejecting the finished coil.

3. A method of continuously coiling a continuous flat strip of low melting point alloy, said method comprising the following steps:

a. advancing the strip longitudinally at substantially constant speed through first and second longitudinally spaced sets of pinch driving rollers having parallel axes;

b. deflecting the end portion of the strip upwardly at the exit from said second set of pinch driving rollers, and continuing to advance said strip to form by bending beyond the elastic limit with substantially circumferential movement of the end of the strip a partial loop capable of clearing an upper one of the second set of pinch driving rollers;

c. discontinuing the deflection of said strip while continuing the longitudinal advancement thereof to advance said partial loop and strip to a coil drive roller and a guide roller having axes substantially parallel to said first axes and initially located to engage an outboard circumferential surface of the partial coil substantially simultaneously to impart circumferential motion thereto in a windup direction and thereafter to move so as to maintain engagement with the periphery of the coil formed by continued winding action;

d. shearing the strip prior to the second set of pinch driving rollers;

e. continuing the coiling of the severed strip by continued advancement thereof by the coil drive roller while concurrently deflecting the succeeding end portion of the strip to form another partial loop; and f. ejecting the finished coil.

4. A method of continuously coiling a continuous flat strip of low melting point alloy, said method comprising the following steps:

a. advancing the strip longitudinally by first and second longitudinally spaced sets of pinch driving rollers;

b. deflecting the end portion of the strip upwardly at the exit from said second set of pinch driving rollers, and continuing to advance said strip and upwardly deflect said end portion to form a partial loop having a radius greater than the radius of said pinch driving rollers and subtending an angle less than 360° to leave a gap greater than the diameter of said pinch driving rollers;

c. discontinuing the deflection of said strip while continuing the longitudinal advancement thereof to advance said loop and strip to a coil drive roller and a guide roller;

d. coiling the advancing partial loop and strip into a coil of a predetermined diameter;

e. shearing the strip between the first and second sets of pinch driving rollers;

f. continuing the coiling of the severed strip by continued advancement thereof by the coil drive roller while concurrently deflecting the succeeding end portion of the strip to form another partial loop; and g. ejecting the finished coil.

5. A method of continuously producing coils from continuous flat strip material of low melting point alloy, said method comprising the following steps:

a. feeding the strip material at a predetermined angle of incidence onto a first rotatably powered roller;

b. lowering a first overhead roller to pinch the strip material between the rollers such that it is continuously driven by the rotating bottom roller between two adjacent and vertically spaced apart shear blades and thence onto a second rotatably powered roller;

c. lowering a second overhead roller to pinch the strip material between the rollers such that the second rotatably powered roller supplements the driving action of the first rotatably powered roller;

d. advancing a primary loop-forming roller toward the axis of the second overhead roller so as to contact the advancing strip material as it exits from the two additional pinch rollers and cause the leading end thereof to loop approximately 270° of a full circle;

e. retracting the loop-forming roller to a point where it serves as a rotatable support for the advancing flat strip material, the open 90° portion of the partial loop clearing the second overhead roller as the strip material advances;

f. feeding the partial loop and strip material to a coil drive roller and a guide roller adapted to cause continuous coiling of the partial loop and the oncoming strip material into a finished coil;

g. shearing the strip metal sheet to a predetermined overall length by lowering the upper shear blade past the lower shear blade, the blades being adapted to advance with the strip metal during the shearing operation;

h. continuing the coiling of the severed end of the strip by continued advancement thereof by the drive roller while concurrently deflecting the succeeding end portion of the strip to form another partial loop; and i. ejecting the finished coil.

6. A method of producing coils from strip material, said method comprising the following steps:

a. inserting the strip material at a predetermined angle of incidence between two vertically spaced apart parallel axes pinch rollers, the bottom roller being rotatably powered and the top roller being vertically movable to clamp the strip material between the rollers such that it is driven through by the rotating bottom roller;

b. feeding the strip material via the rotatably powered bottom roller between two adjacent and vertically spaced apart shear blades;

c. feeding the strip material via the rotatably powered bottom roller between two additional vertically spaced apart parallel axes pinch rollers, the bottom roller being rotatably powered and the top roller being vertically movable to clamp the strip material between the rollers such that the rotating bottom roller supplements the driving action of the first mentioned rotatably powered bottom roller;

d. advancing a primary loop former roller toward said additional top pinch roller so as to contact the advancing strip material as it exits from the two additional pinch rollers and cause it to loop approximately 270° of a full circle;

e. retracting the loop former roller to a point where it serves as a rotatable support for the advancing strip material, the open 90° portion of the partial loop clearing the top pinch roller as the strip material advances;

f. feeding the partial loop and strip material to an upcoiler nest including a pivotable ejector roller, a rotatably powered drive roller, and a guide roller pivotable about the drive roller, the drive and guide rollers being positioned so as to cause continuous coiling of the partial loop and the oncoming strip material into a finished coil;

g. shearing the strip metal sheet to a predetermined length by lowering the upper shear blade past the lower shear blade;

h. continuing the coiling of the severed strip by continued advancement thereof by the drive roller while concurrently deflecting the succeeding end portion of the strip by the primary loop former roller to form another partial loop; and i. ejecting the finished coil off of the drive and guide rollers by actuating the pivotable ejector roller against the finished coil.

* * * * *